US011691653B2

(12) United States Patent
Dede et al.

(10) Patent No.: US 11,691,653 B2
(45) Date of Patent: Jul. 4, 2023

(54) RUNNING GEAR WITH A STEERING ACTUATOR, ASSOCIATED RAIL VEHICLE AND CONTROL METHOD

(71) Applicant: Bombardier Transportation GmbH, Berlin (DE)

(72) Inventors: Jani Dede, Siegen (DE); Arne Pfeil, Siegen (DE)

(73) Assignee: Bombardier Transportation GmbH, Berlin (DE)

( * ) Notice: Subject to any disclaimer, the term of this patent is extended or adjusted under 35 U.S.C. 154(b) by 447 days.

(21) Appl. No.: 16/649,176

(22) PCT Filed: Sep. 21, 2018

(86) PCT No.: PCT/EP2018/075645
§ 371 (c)(1),
(2) Date: Mar. 20, 2020

(87) PCT Pub. No.: WO2019/057917
PCT Pub. Date: Mar. 28, 2019

(65) Prior Publication Data

US 2020/0216101 A1 Jul. 9, 2020

(30) Foreign Application Priority Data

Sep. 22, 2017 (GB) ..... 1715373

(51) Int. Cl.
*B61F 5/52* (2006.01)
*B61F 3/16* (2006.01)
(Continued)

(52) U.S. Cl.
CPC ..... *B61F 3/16* (2013.01); *B61F 5/386* (2013.01); *B61F 5/52* (2013.01); *B61F 5/245* (2013.01); *B61F 5/44* (2013.01)

(58) Field of Classification Search
CPC .... B61F 3/16; B61F 5/386; B61F 5/52; B61F 5/245; B61F 5/44; B61F 5/24; B61F 5/38; B61F 5/00
See application file for complete search history.

(56) References Cited

U.S. PATENT DOCUMENTS 4,640,198 A * 2/1987 Haupl ..... B61F 5/386 105/168
6,038,981 A 3/2000 Daberkow et al.
(Continued)

FOREIGN PATENT DOCUMENTS

CN 103072590 A * 5/2013
DE 4218949 A1 12/1993
(Continued)

OTHER PUBLICATIONS

DE19918071 (English translation) (Year: 2000).*

*Primary Examiner* — Mark T Le
(74) *Attorney, Agent, or Firm* — The Webb Law Firm

(57) ABSTRACT

A running gear for a rail vehicle includes first and second independent wheel assemblies on opposite sides of a longitudinal vertical median plane of the running gear, each having an independent wheel and a bearing assembly for guiding the wheel about a revolution axis fixed relative to the bearing assembly. In a reference position of the running gear, the revolution axes of the first and second wheel assemblies are coaxial and perpendicular to the longitudinal vertical median plane. The running gear further includes one or more steering actuators for moving the bearing assembly of at least one of the two wheel assemblies away from the reference position in a longitudinal direction parallel to the longitudinal vertical median plane, a wheel flange contact detection unit for detecting a contact between a flange of the wheel with a rail, and a controller for controlling the one or more steering actuators.

14 Claims, 2 Drawing Sheets

(51) Int. Cl.

| | |
|---|---|
| ***B61F 5/38*** | (2006.01) |
| *B61F 5/24* | (2006.01) |
| *B61F 5/44* | (2006.01) |

(56) References Cited

U.S. PATENT DOCUMENTS

| | | | | |
|---|---|---|---|---|
| 6,218,961 | B1 * | 4/2001 | Gross | B61L 25/025 246/126 |
| 8,249,776 | B2 * | 8/2012 | Reimann | B61F 5/383 701/19 |
| 2010/0326317 | A1 * | 12/2010 | Simson | B61F 5/383 105/168 |
| 2014/0086517 | A1 | 3/2014 | Norimatsu et al. | |

FOREIGN PATENT DOCUMENTS

| | | | | |
|---|---|---|---|---|
| DE | 19538379 | C1 | 1/1997 | |
| DE | 19918071 | C1 | 7/2000 | |
| DE | 102011085711 | A1 | 3/2013 | |
| EP | 1063143 | A1 | 12/2000 | |
| EP | 1193154 | A1 | 4/2002 | |
| EP | 1457706 | A1 | 9/2004 | |
| GB | 2289877 | A * | 12/1995 | B61C 9/52 |
| KR | 101281492 | B1 * | 7/2013 | |
| WO | 0110697 | A1 | 2/2001 | |

* cited by examiner

RUNNING GEAR WITH A STEERING ACTUATOR, ASSOCIATED RAIL VEHICLE AND CONTROL METHOD

CROSS-REFERENCE TO RELATED APPLICATIONS

This application is the United States national phase of International Application No. PCT/EP2018/075645 filed Sep. 21, 2018, and claims priority to British Patent Application No. 1715373.5 filed Sep. 22, 2017, the disclosures of which are hereby incorporated by reference in their entirety.

BACKGROUND OF THE DISCLOSURE TECHNICAL FIELD

The present invention relates to a running gear with independent wheels for a rail vehicle.

TECHNICAL CONSIDERATIONS

Running gears for rail vehicle include running gears with wheelsets, i.e. pairs of wheels attached to a common axle, which rotate together with the axle, and running gears with independent wheels, i.e. wheels that rotate independently from one another.

Both types of running gears have different advantages and drawbacks. Running gears with wheelsets are subject to hunting oscillations, i.e. swaying motion of the running gear caused by the coning action on which the directional stability of an adhesion railway depends. Various strategies can be developed to counteract such undesired oscillation, including steering, as disclosed e.g. in EP 1 193 154 A1.

The hunting oscillations depend on both wheels of a wheelset rotating at the same angular speed. Therefore, running gears with independent wheels are not subject to hunting oscillations. Despite this absence of hunting oscillations, it has been proposed in EP 1 063 143 A1 to counteract the yaw oscillations of a powered running gear provided with two independent left and right wheels supported by a common frame by means of a passive centring mechanism combined with an adapted control of the independent motors that power the left and right wheels. Running gears with independent wheels, however, are subject to another type of uncontrolled positioning relative to the track, which is not counterbalanced by a passive centring system: more specifically, in certain situations on a straight track, the flange of the wheel on one side of the running gear may contact the head of the rail and stay in contact for a substantial period of time while the running gear is running, which results in undesired differential wear of the wheels on the left and right side of the running gear.

SUMMARY

The invention aims to provide means for minimising the differential wear of wheel flanges on a running gear provided with independent wheels.

According to a first aspect of the invention, there is provided a running gear for a rail vehicle, comprising first and second independent wheel assemblies on opposite first and second sides of a longitudinal vertical median plane of the running gear, each of the first and second independent wheel assemblies comprising an independent wheel and a bearing assembly for guiding the independent wheel about a revolution axis fixed relative to the bearing assembly, wherein in a reference position of the running gear, the revolution axis of the first independent wheel assembly and the revolution axis of the second independent wheel assembly are coaxial and are perpendicular to the longitudinal vertical median plane, characterised in that the running gear further comprises one or more steering actuators for moving the bearing assembly of at least one of the two independent first and second wheel assemblies away from the reference position in a longitudinal direction parallel to the longitudinal vertical median plane, a wheel flange contact detection unit for detecting a contact between a flange of the independent wheel of any of the two independent first and second wheel assemblies with a rail, and a controller for controlling the one or more steering actuators based on signals from the wheel flange contact detection unit.

Thanks to the wheel flange contact detection unit and controller, appropriate actions can be taken to minimise the contact between the wheel flange and the rail, irrespective of whether the wheels are powered or not.

According to a preferred embodiment, the controller is such that whenever a contact between a flange of the independent wheel of a given one of the two independent first and second wheel assemblies is detected while the running gear is running in a running direction, the controller controls the one or more steering actuators to the effect that:

- the bearing assembly of said given one of the first and second wheel assemblies is moved away from the reference position in the running direction, or is maintained in a transient position away from the reference position in the running direction; and/or
- the bearing assembly of the other one of the two independent first and second wheel assemblies is moved away from the reference position in a direction opposed to the running direction, or is maintained in a transient position away from the reference position in the direction opposed to the running direction.

Preferably, the controller comprises means for determining the running direction of the running gear. This simple strategy proves efficient to move the flange of the affected wheel away from the rail head. The controller may include a running direction detector for detecting in which direction the running gear is running.

According to a preferred embodiment, the wheel flange contact detection unit comprises one or more of the following sensors:

- a transverse accelerometer for detecting a transverse acceleration of the bearing assembly of a respective one of the two independent first and second wheel assemblies in a transverse direction parallel to the revolution axis of said respective one of the two independent first and second wheel assemblies;
- an axial load cell for detecting an axial load of a respective one of the two independent first and second wheel assemblies in a transverse direction parallel to the revolution axis of said respective one of the two independent first and second wheel assemblies;
- an optic detector for detecting a distance between a predetermined position fixed relative a non-rotating part of the bearing assembly of a respective one of the two independent first and second wheel assemblies and target part of a rail on which said a respective one of the two independent first and second wheel assemblies runs.

In practice, the processing of the output signals from the one or more sensors may include one or more of the following:

- low pass filtering,
- computation of a RMS value

According to a preferred embodiment, the wheel flange contact detection unit comprises at least a first sensor for detecting a physical parameter of the first independent wheel assembly, a second sensor for detecting a physical parameter of the second independent wheel assembly and a comparator for delivering a flange contact detection signal based on a comparison between signals from the first sensor and second sensor. Comparing measurements on the first independent wheel assembly and second independent wheel assembly helps discriminate the wheel flange contact from artefacts. The comparison may advantageously take place after the output signals from the sensors have been pre-processed. As an example, if the sensors are transverse accelerometers on the first and second bearing assemblies, the output signals of the accelerometers are processed through a low pass filter and an RMS value is computed for each side before the RMS values are compared. A wheel flange contact is detected if the absolute value of the difference between the two RMS values is above a predetermined threshold. The sign of the algebraic difference between the two RMS values defines which of the two sides is subject to wheel flange contact.

According to one embodiment, the bearing assembly of the first independent wheel assembly and the bearing assembly of the first independent wheel assembly are linked by a flexible frame of the running gear. Preferably, the one or more steering actuators are connected to the flexible frame.

According to one embodiment, the flexible frame comprises one or more transverse beams linking to one another the first and second independent wheel assemblies and located below the revolution axes of the first and second independent wheel assemblies in the reference position. Preferably, the wheel flange contact detection unit comprises a first transverse accelerometer for detecting a transverse acceleration of the bearing assembly of the first independent wheel assembly in a first transverse direction parallel to the revolution axis of the first independent wheel assembly, and a second transverse accelerometer for detecting a transverse acceleration of the bearing assembly of the second independent wheel assembly in a second transverse direction parallel to the revolution axis of the second independent wheel assembly.

According to a preferred embodiment, the first transverse accelerometer is located above the revolution axis of the first independent wheel assembly and the second transverse accelerometer is located above the revolution axis of the second independent wheel assembly. This configuration takes advantage from the fact that the flexibility of the flexible frame results in different transverse accelerations on the first and second hand side of the longitudinal vertical median plane of the running gear.

According to another aspect of the invention, there is provided a running gear for a rail vehicle, comprising first and second independent wheel assemblies on opposite first and second sides of a longitudinal vertical median plane of the running gear, each of the first and second independent wheel assemblies comprising an independent wheel and a bearing assembly for guiding the independent wheel about a revolution axis fixed relative to the bearing assembly, wherein in a reference position of the running gear, the revolution axis of the first independent wheel assembly and the revolution axis of the second independent wheel assembly are coaxial and are perpendicular to the longitudinal vertical median plane, characterised in that the running gear further comprises a flexible frame that links the bearing assembly of the first independent wheel assembly and the bearing assembly of the first independent wheel assembly.

By "flexible frame", what is meant is a frame that will actually elastically deform in standard operational conditions. The flexible frame may comprise one or more transverse beams linking to one another the first and second independent wheel assemblies and located below the revolution axes of the first and second independent wheel assemblies in the reference position.

A main normal mode of deformation of the structure is characterised by a bending deformation of the transverse beams, in particular in a vertical plane.

The wheel flange contact detection unit preferably comprises a first transverse accelerometer for detecting a transverse acceleration of the bearing assembly of the first independent wheel assembly in a first transverse direction parallel to the revolution axis of the first independent wheel assembly, and a second transverse accelerometer for detecting a transverse acceleration of the bearing assembly of the second independent wheel assembly in a second transverse direction parallel to the revolution axis of the second independent wheel assembly.

The first transverse accelerometer is preferably located above the revolution axis of the first independent wheel assembly and the second transverse accelerometer is located above the revolution axis of the second independent wheel assembly.

According to a preferred embodiment, the running gear further comprises a wheel flange contact detection unit for detecting a contact between a flange of the independent wheel of any of the two independent first and second wheel assemblies with a rail, wherein the wheel flange contact detection unit comprises at least a first sensor for detecting a physical parameter of the first independent wheel assembly, a second sensor for detecting a physical parameter of the second independent wheel assembly and a comparator for delivering a flange contact detection signal based on a comparison between signals from the first sensor and second sensor.

According to a preferred embodiment, the running gear further comprises one or more steering actuators for moving the bearing assembly of at least one of the two independent first and second wheel assemblies away from the reference position in a longitudinal direction parallel to the longitudinal vertical median plane.

According to a preferred embodiment, the running gear further comprises a controller for controlling the one or more steering actuators based on signals from the wheel flange contact detection unit.

According to another aspect of the invention, there is provided a rail vehicle comprising a vehicle body and one or more running gears, wherein the one or more steering actuator are linked to the vehicle body.

Preferably, the rail vehicle is a low floor light rail vehicle. Accordingly, part of the vehicle body is located below an upper end of the wheel of the first and second wheel assemblies.

According to another aspect of the invention, there is provided a control method for controlling a running gear of a rail vehicle, the running gear comprising first and second independent wheel assemblies on opposite first and second sides of a longitudinal vertical median plane of the running gear, each of the first and second independent wheel assemblies comprising an independent wheel and a bearing assembly for guiding the independent wheel about a revolution axis fixed relative to the bearing assembly, wherein in a reference position of the running gear, the revolution axis of the first independent wheel assembly and the revolution axis of the second independent wheel assembly are coaxial and are perpendicular to the longitudinal vertical median plane, the method comprising the following steps:

detecting a contact between a flange of the independent wheel of any of the two independent first and second wheel assemblies with a rail, and moving the bearing assembly of at least one of the two independent first and second wheel assemblies away from the reference position in a longitudinal direction parallel to the longitudinal vertical median plane based on a result of said detection step.

Advantageously, the running gear runs in a running direction, and the step of moving the bearing assembly of at least one of the two independent first and second wheel assemblies away from the reference position in a longitudinal direction parallel to the longitudinal vertical median plane based on a result of said detection step comprises, whenever a contact between a flange of the independent wheel of a given one of the two independent first and second wheel assemblies is detected while the running gear is running in a running direction, at least one of the following two steps:

moving the bearing assembly of said given one of the first and second wheel assemblies away from the reference position in the running direction, or maintaining the bearing assembly of said given one of the first and second wheel assemblies in a transient position away from the reference position in the running direction; and/or moving the bearing assembly of the other one of the two independent first and second wheel assemblies away from the reference position in a direction opposed to the running direction, or maintaining the other one of the two independent first and second wheel assemblies in a transient position away from the reference position in the direction opposed to the running direction.

The method may include a step of detecting the predetermined running direction.

According to a preferred embodiment, detecting a contact between a flange of the independent wheel of any of the two first and second independent wheel assemblies with a rail comprises detecting a physical parameter of the first independent wheel assembly, detecting a physical parameter of the second independent wheel assembly and issuing an output signal based on a comparison between the detected physical parameter of the first independent wheel assembly and the detected physical parameter of the second independent wheel assembly.

BRIEF DESCRIPTION OF THE DRAWINGS

Other advantages and features of the invention will then become more clearly apparent from the following description of a specific embodiment of the invention given as non-restrictive examples only and represented in the accompanying drawings in which.

Corresponding reference numerals refer to the same or corresponding parts in each of the figures.

DETAILED DESCRIPTION OF THE INVENTION

Figure 1:
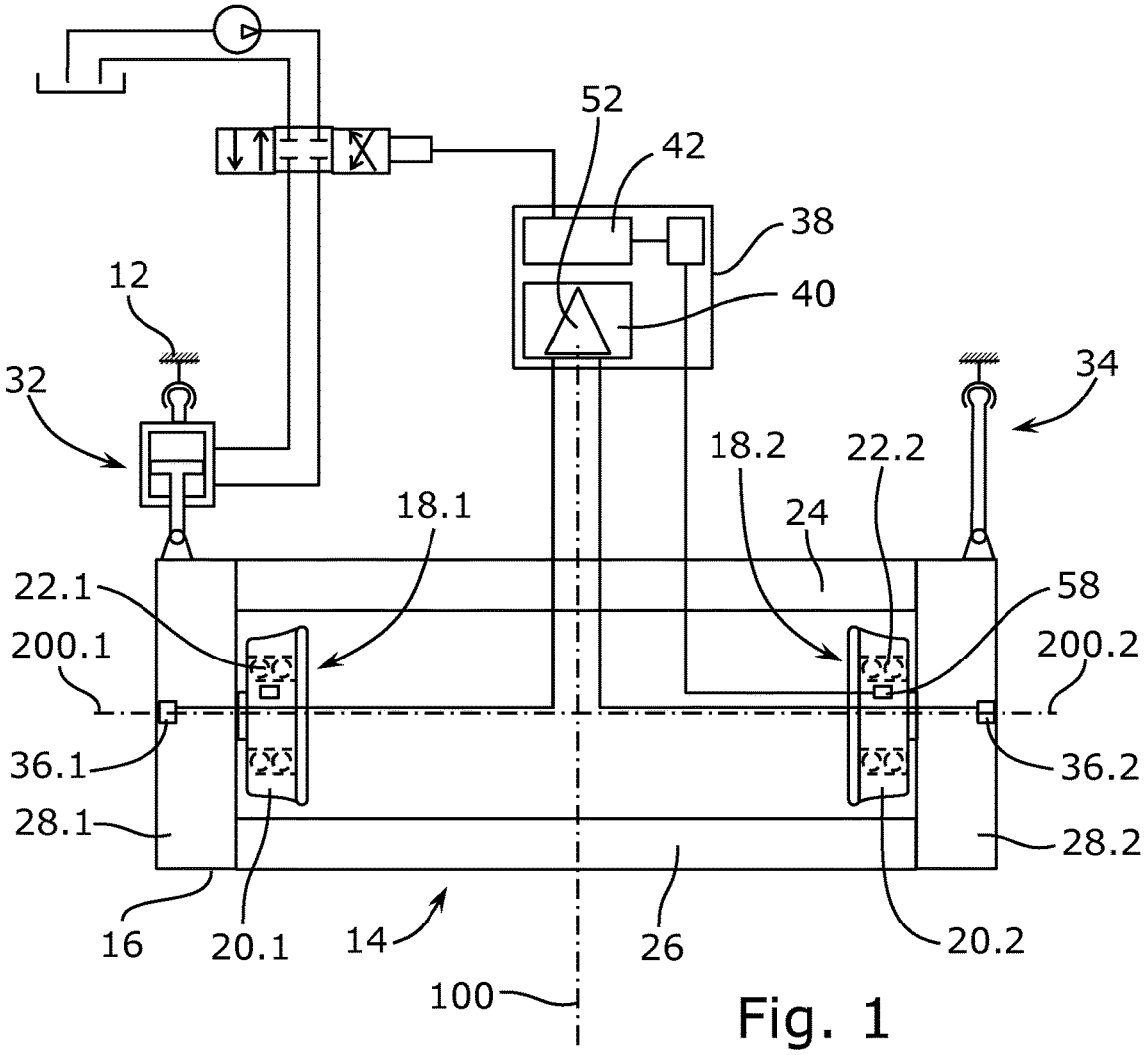
FIG. 1 is a top view of a running gear according to an embodiment of the invention.
Figure 2:
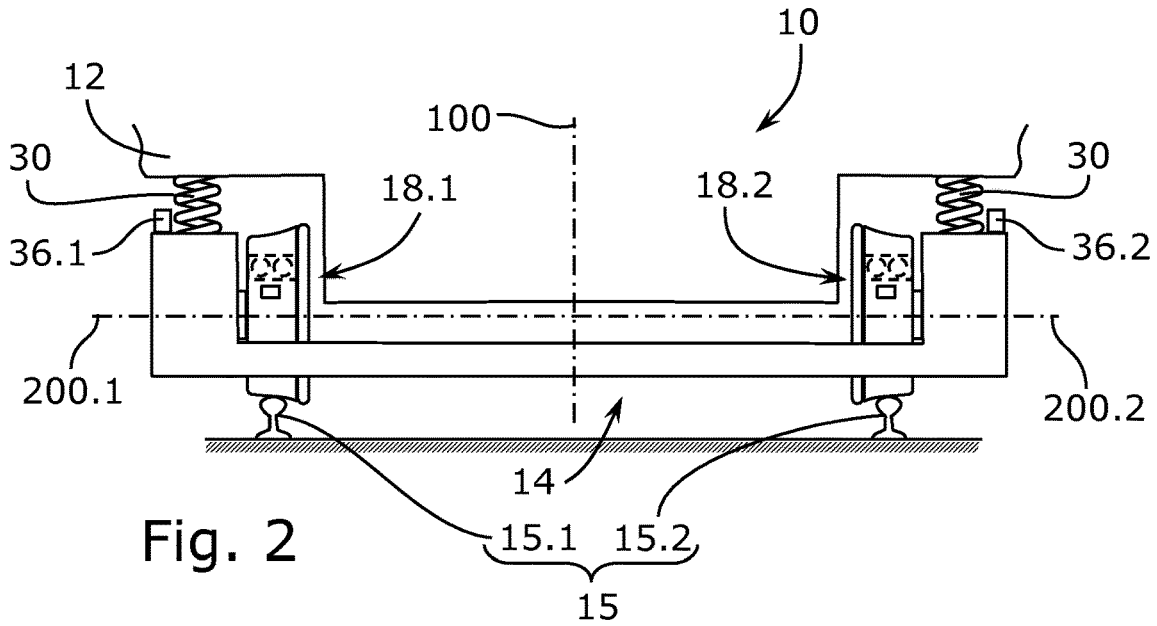
FIG. 2 is front view of the running gear of FIG. 1.

A portion of a low floor light rail vehicle 10 illustrated in FIGS. 1 and 2 comprises a vehicle body 12 supported on a running gear 14 running on a parallel rails 15.1, 15.2 of a track 15. In FIGS. 1 and 2, a median longitudinal vertical reference plane 100 of the running gear 14 has been materialised. The reference plane 100 of the running gear 14 are coplanar with a median longitudinal vertical reference plane of the vehicle body 12 when the rail vehicle is in a straight reference position.

The running gear 14 comprises a light rectangular cast frame 16 on which first and second independent wheel assemblies 18.1, 18.2 are mounted on opposite first and second (left and right) sides of the longitudinal vertical median plane 100 of the running gear 14. Each of the first and second independent wheel assemblies 18.1, 18.2 comprises a wheel 20.1, 20.2 and a bearing assembly 22.1, 22.2 for guiding the independent wheel 20.1, 20.2 about a revolution axis 200.1, 200.2 fixed relative to the bearing assembly 22.1, 22.2. The cast frame 16 consists of two parallel bendable transverse beams 24, 26 and two short first and second longitudinal beams 28.1, 28.2 which are integral with a fixed part of the respective bearing assembly 22.1, 22.2. The transverse beams 24, 26 have a stiffness which allows elastic deformations in the standard operational conditions of the running gear 14. The main normal mode of deformation of the structure is characterised by a bending deformation of the transverse beams 24, 26, in particular in a vertical plane. In a reference position of the running gear 14, the revolution axes 200.1, 200.2 of the two wheel assemblies 18.1, 18.2 are coaxial and perpendicular to the vertical median longitudinal reference plane 100 of the running gear 14. In the reference position, the two revolution axes 200.1, 200.2 are above the transverse beams 24, 26. More specifically, the two revolution axes 200.1, 200.2 are parallel to and at a distance above a horizontal plane containing the neutral axes of the two transverse beams 24, 26. This arrangement is somewhat similar to a dropped axle arrangement in an automotive vehicle and provides the advantage of lowering the floor of the vehicle body 12 without decreasing the diameter of the wheels 20.1, 20.2.

The vehicle body 12 is connected to the frame 16 by means of a vertical suspension including vertical springs 30, which have been depicted as coil springs but could alternatively be air springs or any suitable type of vertical suspension elements.

The frame 16 is further linked to the vehicle body 16 by means of a bidirectional steering actuator 32 on one side of the frame 16 and of a connecting rod 34 on the other side.

The expression "steering actuator" in this context designates any kind of actuator that is capable of effecting a displacement of the corresponding part of the frame 16 in the longitudinal direction of the running gear 14. The steering actuator 32 itself can be a hydraulic cylinder, which can be oriented in the longitudinal direction as illustrated in FIG. 1 or in another direction and linked to the frame with a bellcrank. It can also be integrated in a tie rod bearing, as disclosed in EP1457706B1, the content of which is incorporated here by reference. Other type of actuators, such as a worm gear motor are also possible.

As will be readily understood, a displacement of the side of the frame linked to the steering actuator 32 in the longitudinal direction of the running gear 14 results in a pivot movement of the whole frame 16 and of the running gear 14 about an imaginary instantaneous vertical pivot axis defined by the connecting rod connection on the opposite side of the frame 16.

The running gear 14 is instrumented with a pair of accelerometers 36.1, 36.2 connected to a processing unit 38. Each accelerometer 36.1, 36.2 is fixed to one of the bearing assemblies 22.1, 22.2 or longitudinal beams 28.1, 28.2 and positioned as far as possible from the horizontal plane containing the neutral axes of the transverse beams 24, 26. Each accelerometer 36.1, 36.2 is oriented to measure the transverse acceleration, i.e. the acceleration in a direction parallel to the revolution axis 200.1, respectively 200.2 of the associated wheel. Due to the elasticity of the running gear frame 16, the accelerations measured by the two accelerometers 36.1, 36.2 differ and the information delivered by each accelerometer signal reflects primarily the acceleration of the associated wheel 20.1, 20.2 in the direction of its revolution axis 200.1, 200.2.

The processing unit 38 comprises a wheel flange contact detection unit 40 for detecting a contact between a flange of the wheel 20.1, 20.2 of any of the first and second independent wheel assemblies 18.1, 18.2 with the corresponding rail 15.1, 15.2, and a controller 42 for controlling the one or more steering actuators 32 based on signals from the wheel flange contact detection unit 40.

Figure 3:
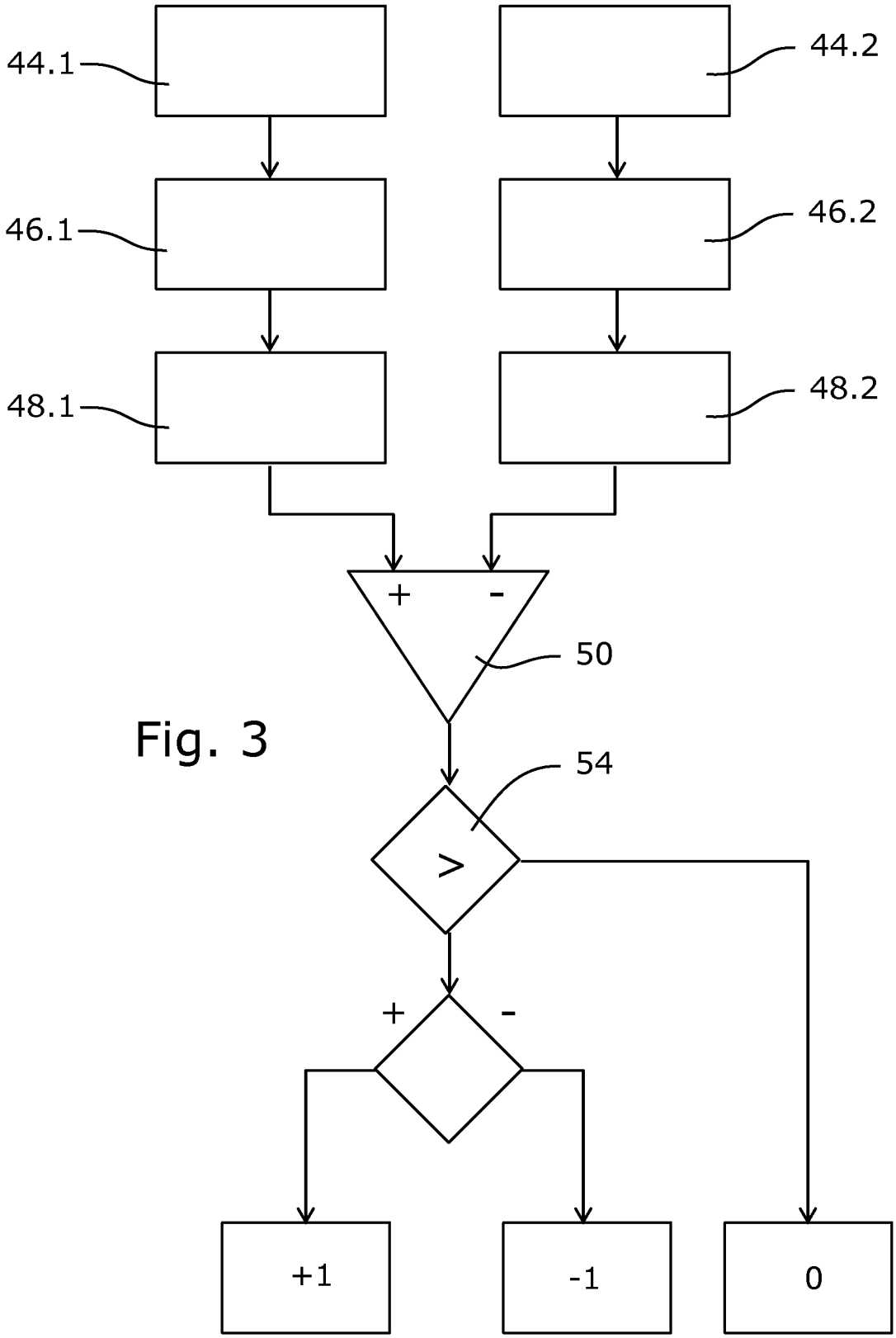
FIG. 3 is flow chart of a method of controlling the running gear of FIG. 1.

As illustrated in the flow chart of FIG. 3, the wheel flange contact detection unit 40 comprises analog and/or digital circuits, which process the output signals 44.1, 44.2 from the first and second accelerometers 36.1, 36.2 each through a low pass filter 46.1, 46.2 and computes in parallel for the two channels successive RMS values of the filtered signal with a given sampling rate of e.g. 0.5 seconds (steps 48.1, 48.2). At step 50, the RMS values from the first and second channels are compared with a comparator 52, which computes an algebraic difference between the first and second RMS values at the sampling rate. If the absolute value of the algebraic difference is below a predetermined threshold at step 54, the output of the wheel flange contact detection unit is "0", i.e. no wheel flange contact has been detected. If the absolute value of the algebraic difference is above said predetermined threshold at step 54, a wheel flange contact has been detected and the output of the wheel flange contact detection unit is either "+1" if the algebraic difference is positive at step 56 or "−1" if the algebraic difference is negative. The value "+1" means that the algebraic difference between the first and second RMS values is positive and above the predetermined threshold, which corresponds to a situation in which the wheel flange of the first wheel assembly 18.1 has contacted the rail. On the other hand, the value "−1" means that the algebraic difference between the first and second RMS values is negative and its absolute value is above the predetermined threshold, which corresponds to a situation in which the flange of the second wheel assembly 18.2 has contacted the rail.

The controller 42 is programmed to control the bidirectional steering actuator 32 based on the output of the wheel flange contact detection unit 40 and on the running direction of the rail vehicle, which can be detected locally e.g. with a rotation sensor 58 housed in one of the bearing assemblies, or obtained from another source on the vehicle. The input signal for the running direction can be either "+1" or "−1", e.g. "+1" if the left side in the running direction coincides with the first side of the running gear 14 and "−1" if the left side in the running direction coincides with the second side of the running gear 14.

If the output of the wheel flange contact detection 40 unit is "0", no action is taken, i.e. the steering actuator does not change the position of the running gear frame. If the output of the wheel flange contact detection unit 40 is "+1" (contact of the flange of the first wheel with the rail) or "−1" (contact of the flange of the second wheel with the rail), the controller 42 will control the steering actuator 32 to effect an incremental displacement of the running gear frame 16, so to either move forward in the running direction the wheel 20.1, 20.2 on which the contact has been detected or move the opposite wheel 20.1, 20.2 in the rearward direction, i.e. in the direction opposed to the running direction. In both cases, this results in a pivotal movement of the frame 16 about an imaginary instantaneous vertical axis defined by hinged connection of the connecting rod 34 in one and the same rotation direction.

Let us assume that the connecting rod 34 is located on the second side of the running gear frame 16 and that this first side of the running gear corresponds the right side in the running direction of the running gear. If the output of the wheel flange contact detection unit is "+1", i.e. if a flange contact has been detected on the first wheel, (i.e. left wheel in the running direction), the steering actuator will be controlled to move the first wheel in the running direction by a given increment, which has been identified as "+1" in the third column of Table 1 below. This results in an incremental clockwise rotation of the running gear with respect to the vehicle body about an imaginary instantaneous vertical axis of the connecting rod 34 in FIG. 1. If the output of the wheel flange contact detection unit 40 is "−1", i.e. if a flange contact has been detected on the second wheel 22.2, (i.e. right wheel in the running direction), the steering actuator will be controlled to move the first wheel 22.1 in the direction opposite to the running direction by a given increment, which has been identified as "−1" in the Table 1 below. This results in an incremental anticlockwise rotation of the running gear 14 with respect to the vehicle body 12 about an imaginary instantaneous vertical axis of the connecting rod 34 in FIG. 1. The situation is reversed if the running direction of the running gear is reversed. All cases are summarised in Table 1 as follows:

TABLE 1

| Output value of wheel flange contact detection unit | Running direction | Increment of steering actuator |
|---|---|---|
| +1 | +1 | +1 |
| +1 | −1 | −1 |
| 0 | +1 | 0 |
| 0 | −1 | 0 |
| −1 | +1 | −1 |
| −1 | −1 | +1 |

This process is iterated at the sampling rate of the wheel flange contact detection unit 40. As will be readily understood, moving the wheel flange that is in contact with the rail 15.1, 15.2 in the running direction relative to the opposite wheel and to the vehicle body taken as a reference reduces the contact force between the wheel flange and the rail and in the end moves the flange away from the rail.

Depending on the type of steering actuator, the controlled physical parameter can be a force, a pressure or a displacement. If the controlled parameter is a force or a pressure, the corresponding displacement increment will vary depending on the running conditions. According to one non-limitative example, the control physical parameter is a force and each increment is of 200 N for a sampling rate of 2 Hz.

As a variant, the connecting rod 34 can be replaced with a second steering actuator which operates with the same magnitude as the first steering actuator but in the opposite direction. As a result, the running gear frame 18 pivots about an imaginary pivot axis, which is located in the median vertical longitudinal plane 100.

The wheel flange contact detection unit 40 for detecting a contact between a flange of the wheel 20.1, 20.2 of any of the two independent first and second wheel assemblies 18.1, 18.2 with a rail 15.1, 15.2 may comprise a couple of axial load cells linked to the wheel axles or bearing assemblies of the first and second wheel assemblies, to measure an axial load on each wheel parallel to the revolution axis of the wheel. Such axial load cells may be integrated into a rolling bearing of the bearing assembly. Rolling bearings with axial force sensors are well known in the art, see e.g. DE 10 2011 085 711 A1, US 2014/0086517, DE 42 18 949.

In FIGS. 1 and 2, the wheels 20.1, 20.2 are located between the longitudinal beams 28.1, 28.2. and between the first and second accelerometers 36.1, 36.2. However, the reverse is also possible, with the longitudinal beams 28.1, 28.2 located outside of the wheels 20.1, 20.2. The bearing assemblies 22.1, 22.2 for guiding the independent wheels 20.1, 20.2 about the revolution axes 200.1, 200.2 may comprise a pin integral with the respective longitudinal beams 28.1, 28.2 and a bearing located within the respective wheel 20.1, 20.2. Alternatively, each wheel 20.1, 20.2 may be provided with an individual axle, which is guided in an axle box integral with a respective one of the longitudinal beams 28.1, 28.2.

The invention claimed is:

1. A rail vehicle comprising a vehicle body and at least one running gear, the running gear comprising:

first and second independent wheel assemblies on opposite first and second sides of a longitudinal vertical median plane of the running gear, each of the first and second independent wheel assemblies comprising:

an independent wheel, and a bearing assembly for guiding the independent wheel about a revolution axis fixed relative to the bearing assembly, a flexible frame linking the bearing assembly of the first independent wheel assembly and the bearing assembly of the second independent wheel assembly, wherein, in a reference position of the running gear, the revolution axis of the first independent wheel assembly and the revolution axis of the second independent wheel assembly are coaxial and are perpendicular to the longitudinal vertical median plane, a steering actuator connected to the flexible frame on one side of the longitudinal vertical median plane and linked to the vehicle body and to either a further steering actuator which operates with the same magnitude but in the opposite direction, or a connecting rod, wherein the further steering actuator or the connecting rod is connected to the flexible frame on the other side of the longitudinal vertical median plane and linked to the vehicle body, at least one of the steering actuator and the further steering actuator configured for effecting a displacement of a part of the flexible frame relative to the vehicle body in a longitudinal direction of the running gear parallel to the longitudinal vertical median plane and moving the bearing assembly of at least one of the two independent first and second wheel assemblies away from the reference position in the longitudinal direction, a wheel flange contact detection unit for detecting a contact between a flange of the independent wheel of any of the two independent first and second wheel assemblies with a rail, and a controller for controlling the steering actuator and the further steering actuator based on signals from the wheel flange contact detection unit.

2. The rail vehicle of claim 1, wherein the controller is such that whenever a contact between a flange of the independent wheel of a given one of the two independent first and second wheel assemblies and the rail is detected while the running gear is running in a running direction, the controller controls the steering actuator and the further steering actuator to the effect that at least one of:

the bearing assembly of said one of the first and second wheel assemblies is moved away from the reference position in the running direction, or is maintained in a transient position away from the reference position in the running direction; and the bearing assembly of the other one of the two independent first and second wheel assemblies is moved away from the reference position in a direction opposed to the running direction, or is maintained in a transient position away from the reference position in the direction opposed to the running direction.

3. The rail vehicle of claim 2, wherein the controller comprises a sensor for determining the running direction of the running gear.

4. The rail vehicle of claim 1, wherein the wheel flange contact detection unit comprises one or more of the following sensors:

a transverse accelerometer for detecting a transverse acceleration of the bearing assembly of a respective one of the two independent first and second wheel assemblies in a transverse direction parallel to the revolution axis of said respective one of the two independent first and second wheel assemblies;

an axial load cell for detecting an axial load of a respective one of the two independent first and second wheel assemblies in a transverse direction parallel to the revolution axis of said respective one of the two independent first and second wheel assemblies; and an optic detector for detecting a distance between a predetermined position fixed relative to a non-rotating part of the bearing assembly of a respective one of the two independent first and second wheel assemblies and target part of a rail on which said a respective one of the two independent first and the second wheel assemblies runs.

5. The rail vehicle of claim 1, wherein the wheel flange contact detection unit comprises at least a first sensor for detecting a physical parameter of the first independent wheel assembly, a second sensor for detecting a physical parameter of the second independent wheel assembly and a comparator for delivering a flange contact detection signal based on a comparison between signals from the first sensor and the second sensor.

6. The rail vehicle of claim 1, wherein the flexible frame comprises one or more transverse beams linking to one another the first and second independent wheel assemblies and located below the revolution axes of the first and second independent wheel assemblies in the reference position.

7. The rail vehicle of claim 1, wherein the wheel flange contact detection unit comprises a first transverse accelerometer for detecting a transverse acceleration of the bearing assembly of the first independent wheel assembly in a first transverse direction parallel to the revolution axis of the first independent wheel assembly, and a second transverse accelerometer for detecting a transverse acceleration of the bearing assembly of the second independent wheel assembly in a second transverse direction parallel to the revolution axis of the second independent wheel assembly.

8. The rail vehicle of claim 7, wherein the first transverse accelerometer is located above the revolution axis of the first independent wheel assembly and the second transverse accelerometer is located above the revolution axis of the second independent wheel assembly.

9. The rail vehicle of claim 1, wherein part of the vehicle body is located below an upper end of the wheel of the first and second wheel assemblies.

10. A control method for controlling a running gear of a rail vehicle, the rail vehicle comprising a vehicle body, the running gear having first and second independent wheel assemblies on opposite first and second sides of a longitudinal vertical median plane of the running gear, each of the first and second independent wheel assemblies having an independent wheel and a bearing assembly for guiding the independent wheel about a revolution axis fixed relative to the bearing assembly, the running gear comprising a flexible frame linking the bearing assembly of the first independent wheel assembly and the bearing assembly of the second independent wheel assembly, wherein, in a reference position of the running gear, the revolution axis of the first independent wheel assembly and the revolution axis of the second independent wheel assembly are coaxial and are perpendicular to the longitudinal vertical median plane, the method comprising:

detecting a contact between a flange of the independent wheel of any of the two independent first and second wheel assemblies with a rail, and effecting a displacement of a part of the flexible frame in a longitudinal direction of the running gear parallel to the longitudinal vertical median plane so as to move the bearing assembly of at least one of the two independent first and second wheel assemblies away from the reference position in a longitudinal direction parallel to the longitudinal vertical median plane based on detecting the contact.

11. The method of claim 10, wherein the running gear runs in a running direction, and effecting a displacement of a part of the flexible frame in a longitudinal direction of the running gear parallel to the longitudinal vertical median plane so as to move the bearing assembly of at least one of the two independent first and second wheel assemblies away from the reference position in a longitudinal direction parallel to the longitudinal vertical median plane based on a result of detecting the contact comprises, whenever the contact between the flange of the independent wheel of a given one of the two independent first and second wheel assemblies and the rail is detected while the running gear is running in a running direction, at least one of the following two steps:

effecting a displacement of a part of the flexible frame in a longitudinal direction of the running gear parallel to the longitudinal vertical median plane so as to move the bearing assembly of said one of the first and second wheel assemblies away from the reference position in the running direction, or maintaining the part of the flexible frame so as to maintain the bearing assembly of said one of the first and second wheel assemblies in a transient position away from the reference position in the running direction; and effecting a displacement of a part of the flexible frame in a longitudinal direction of the running gear parallel to the longitudinal vertical median plane so as to move the bearing assembly of the other one of the two independent first and second wheel assemblies away from the reference position in a direction opposed to the running direction, or maintaining the part of the flexible frame so as to maintain the other one of the two independent first and second wheel assemblies in a transient position away from the reference position in the direction opposed to the running direction.

12. The method of claim 10, wherein detecting the contact between the flange of the independent wheel of any of the two first and second independent wheel assemblies with a rail comprises detecting a physical parameter of the first independent wheel assembly, detecting a physical parameter of the second independent wheel assembly, and issuing an output signal based on a comparison between the detected physical parameter of the first independent wheel assembly and the detected physical parameter of the second independent wheel assembly.

13. The rail vehicle of claim 1, wherein the running gear comprises said further steering actuator connected to the flexible frame on the other side of the longitudinal vertical median plane and linked to the vehicle body.

14. The rail vehicle of claim 1, wherein the running gear comprises said connecting rod connected to the flexible frame on the other side of the longitudinal vertical median plane and linked to the vehicle body.

* * * * *